US010753242B2

(12) United States Patent
Kaushik et al.

(10) Patent No.: US 10,753,242 B2
(45) Date of Patent: Aug. 25, 2020

(54) SYSTEMS AND METHODS FOR PERFORMING A CONDITION-BASED MAINTENANCE OF AN ENGINE

(71) Applicant: General Electric Company, Schenectady, NY (US)

(72) Inventors: Anshul Kaushik, Bangalore (IN); Saratchandra Shanmukh, Bangalore (IN); Chithra Parayalil, Bangalore (IN); Subramani Adhichari, Bangalore (IN)

(73) Assignee: General Electric Company, Schenectady, NY (US)

( * ) Notice: Subject to any disclaimer, the term of this patent is extended or adjusted under 35 U.S.C. 154(b) by 257 days.

(21) Appl. No.: 15/806,490

(22) Filed: Nov. 8, 2017

(65) Prior Publication Data

US 2018/0128134 A1 May 10, 2018

(30) Foreign Application Priority Data

Nov. 9, 2016 (IN) ..... 201641038355

(51) Int. Cl.

| | |
|---|---|
| ***F01M 11/10*** | (2006.01) |
| ***F02D 41/22*** | (2006.01) |
| ***G07C 5/00*** | (2006.01) |
| ***F02D 41/26*** | (2006.01) |
| ***G07C 5/08*** | (2006.01) |

(52) U.S. Cl.

CPC ..... *F01M 11/10* (2013.01); *F02D 41/22* (2013.01); *G07C 5/006* (2013.01); *G07C 5/0808* (2013.01); *G07C 5/0816* (2013.01); *F01M 2011/1466* (2013.01); *F01M 2250/60* (2013.01); *F02D 41/26* (2013.01); *F02D 2041/228* (2013.01)

(58) Field of Classification Search

CPC ..... F01M 11/10; F02D 41/22; F02D 41/26; F02D 2041/228; G07C 5/006; G07C 5/0816; G07C 5/0808

See application file for complete search history.

(56) References Cited

U.S. PATENT DOCUMENTS

| | | | | |
|---|---|---|---|---|
| 5,074,381 | A | 12/1991 | Minard et al. | |
| 6,712,080 | B1 | 3/2004 | Handschuh et al. | |
| 2012/0130617 | A1 | 5/2012 | Raimarckers et al. | |
| 2018/0030890 | A1* | 2/2018 | Roe et al. ..... | F02B 77/04 |

FOREIGN PATENT DOCUMENTS

| | | | |
|---|---|---|---|
| EP | 0 250 058 | B1 | 3/1993 |

* cited by examiner

*Primary Examiner* — Basil T. Jos
(74) *Attorney, Agent, or Firm* — Wood IP LLC

(57) ABSTRACT

A method for performing condition-based maintenance of an engine is presented. The method includes obtaining one or more parameters corresponding to the engine. Also, the method includes determining a temperature profile corresponding to a portion of a fluid flow component based on a first parameter and one or more thermal models. The method further includes estimating a solid deposit in the portion of the fluid flow component corresponding to each cycle of the engine based on the temperature profile and deposition kinetics parameters. Further, the method includes predicting a total solid deposit in the portion of the fluid flow component based on the estimated solid deposit corresponding to each cycle of the engine. Moreover, the method includes performing the condition-based maintenance of the engine based on a value of the predicted total solid deposit.

19 Claims, 6 Drawing Sheets

SYSTEMS AND METHODS FOR PERFORMING A CONDITION-BASED MAINTENANCE OF AN ENGINE

BACKGROUND

Embodiments of the present specification relate generally to maintenance of an engine, and more particularly to systems and methods for performing a condition-based maintenance of the engine.

Unwanted deposits in fluid flow components may lead to several operational problems in modern engines. For example, formation of coke deposits in the lubrication subsystem of an engine can lead to blocked lubricating tubes, and thus reduced performance of the lubrication subsystem. In a turbine engine, excessive coke deposition on the inner surface of a scavenge tube or any other tube or component of the lubricating system may result in reduced oil flow between components of the lubricating system. This in turn may result in a drop in oil levels, potentially leading to events such as In-Flight-Shut-Down and Unscheduled-Engine-Removal.

Oil coking or formation of coke deposits in the lubrication subsystem occurs due to thermal breakdown of oil at high temperatures. Disadvantageously, oil coking in the lubrication subsystem of an engine can lead to catastrophic failures. Similarly, other deposits in the fluid flow components may adversely affect the performance of the engine. Some examples of these other deposits include deposits formed due to varnish and sludge formation, scales, paraffin deposits, and the like.

Currently available techniques to resolve this problem of unwanted deposits entail inspection of affected fluid flow components at periodic intervals and removal of the unwanted deposits. Traditionally, the schedule of such periodic maintenance is determined based on historical data and is agnostic to an actual amount of deposit formed in a given engine, consequently resulting in the unnecessary inspection of engines. This leads to loss of productivity (or time-on-wing, for aviation engines) and additional maintenance costs.

BRIEF DESCRIPTION

In accordance with aspects of the present specification, a method for performing a condition-based maintenance of an engine is presented. The method includes obtaining one or more parameters corresponding to the engine. Also, the method includes determining a temperature profile corresponding to a portion of a fluid flow component in the engine based on a first parameter of the one or more parameters and one or more thermal models. The method further includes estimating a solid deposit in the portion of the fluid flow component corresponding to each cycle of the engine based on the temperature profile and one or more deposition kinetics parameters. Moreover, the method includes predicting the total solid deposit in the portion of the fluid flow component based on the estimated solid deposit corresponding to each cycle of the engine. In addition, the method includes performing the condition-based maintenance of the engine based on a value of the predicted total solid deposit In accordance with another aspect of the present specification, a system for performing a condition-based maintenance of an engine is presented. The system includes one or more sensors configured to measure one or more parameters corresponding to the engine and a control subsystem operatively coupled to a fluid flow component of the engine.

Further, the control subsystem includes at least one data unit configured to receive the one or more parameters corresponding to the engine, at least one prediction unit configured to predict a total solid deposit in the fluid flow component of the engine and determine a condition-based maintenance requirement based on a value of the predicted total solid deposit. The control subsystem further includes at least one communication unit configured to communicate at least one of a condition-based maintenance schedule, the predicted total solid deposit, the condition-based maintenance requirement, the temperature profile, an alert signal, or combinations thereof to a display device, a control unit, a system operator, a remote unit, or combinations thereof. The system further includes a maintenance unit operatively coupled to the control subsystem, wherein the maintenance unit is configured to perform the condition-based maintenance of the engine based on the condition-based maintenance requirement determined by the prediction unit.

In accordance with yet another aspect of the present specification, a system is presented. The system includes an engine which includes at least a lubrication subsystem. The system also includes at least one sensor configured to measure a temperature of at an exhaust location of an engine and a control subsystem operatively coupled to the lubricating subsystem and the at least one sensor. The control subsystem further includes a data unit, a prediction unit, an error correction unit and a communication unit. The data unit is configured to receive temperature data from the at least one sensor. The prediction unit is configured to determine a temperature profile corresponding to a portion of the lubrication subsystem based on the temperature data and one or more thermal models, estimate a coke deposit in at least the portion of the lubrication subsystem corresponding to each cycle of the engine based on the temperature profile and one or more deposition kinetics parameters and predict a total coke deposit in at least the portion of the lubrication subsystem based on the estimated coke deposit corresponding to each cycle of the engine. Further, the prediction unit is configured to compare the predicted total coke deposit to a determined coke deposit threshold value and determine a condition-based maintenance requirement based on the comparison. The error correction unit is configured to compare the predicted total coke deposit with a measured coke deposit corresponding to at least the portion of the lubrication subsystem and update one or more deposition kinetics parameters based on the comparison. The communication unit is configured to communicate one or more of a condition-based maintenance schedule, the condition-based maintenance requirement, the predicted total solid deposit, the temperature profile, an alert signal, or combinations thereof to a display device, a control unit, a system operator, a remote unit, or combinations thereof. The system further includes a maintenance unit operatively coupled to the control subsystem, wherein the maintenance unit is configured to perform the condition-based maintenance of the engine based on the condition-based maintenance requirement.

DRAWINGS

These and other features, aspects, and advantages of the present specification will become better understood when the following detailed description is read with reference to the accompanying drawings in which like characters represent like parts throughout the drawings, wherein.

DETAILED DESCRIPTION

Figure 1:
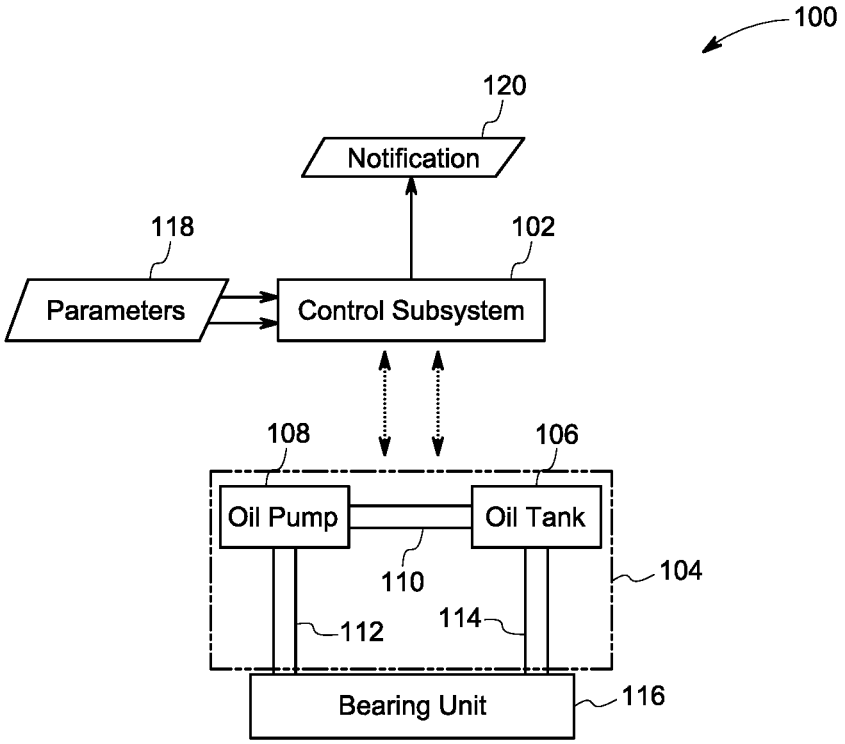
FIG. 1 is a diagrammatical representation of a system for performing a condition-based maintenance of an engine, in accordance with aspects of the present specification.

As will be described in detail hereinafter, various embodiments of systems and methods for performing a condition-based maintenance of an engine are presented. In particular, the system is configured to predict the quantity or amount of a total solid deposit in a fluid flow component in an engine via use of sensor data and first principle physics based models. Further, the system is configured to use the prediction of the amount of total solid deposits in fluid flow components to determine the need for maintenance of the fluid flow component, and also schedule and/or perform the condition-based maintenance of the engine instead of a fixed interval or periodic maintenance.

In certain embodiments, the solid deposit includes a coke deposit and the fluid flow component includes a component of a lubrication subsystem such as a scavenge tube. For ease of description, the systems and methods are described in the context of predicting a total coke deposit in a lubrication subsystem of an engine and performing a condition-based maintenance to remove the unwanted coke deposit from the lubrication system of the engine. However, the requirement for condition-based maintenance may arise due to any deposit in any fluid flow component of an engine. These systems and methods may also be used for predicting the solid deposits in the various fluid flow components of the engine as well as performing the required condition-based maintenance of the engine.

It may be noted that the terms 'solid deposit' and 'amount of solid deposit' are used interchangeably. In a similar fashion, the terms 'coke deposit' and 'amount of coke deposit' are used interchangeably. Also, the terms 'predicted total solid deposit' and 'predicted value of total amount of solid deposit amount' are used interchangeably. In addition, the terms 'estimated solid deposit' and 'estimated value of amount of solid deposit' are used interchangeably. Similarly, the terms 'measured solid deposit' and 'value of amount of solid deposit' are used interchangeably.

In the following specification and the claims, the singular forms "a," "an," and "the" include plural referents unless the context clearly dictates otherwise. As used herein, the term "or" is not meant to be exclusive and refers to at least one of the referenced components being present and includes instances in which a combination of the referenced components may be present, unless the context clearly dictates otherwise.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances, the modified term may sometimes not be appropriate, capable, or suitable.

Turning now to the drawings, by way of example in FIG. 1, a diagrammatical representation of a system 100 for performing a condition-based maintenance of an engine, in accordance with aspects of the present specification, is presented. In particular, the system is configured to perform the condition-based maintenance based on a predicted total solid deposit in one or more fluid flow components in the engine. As will be appreciated by one skilled in the art, the figures are for illustrative purposes and are not drawn to scale.

In a presently contemplated configuration, the system 100 for performing a condition-based maintenance includes a control subsystem 102 and a lubricating subsystem 104. In certain embodiments, the lubricating subsystem 104 includes an oil tank 106, an oil pump 108, a connecting tube 110, a supply tube 112, and a scavenge tube 114. The lubrication subsystem 104 is coupled to a bearing unit 116 through the supply tube 112 and scavenge tube 114. The bearing unit 116 may include one or more bearings (not shown). It may be noted that the lubrication subsystem 104 and the bearing unit 116 are components of an engine (not shown). Also, the engine may be a turbine or a reciprocating engine.

As will be appreciated, during operation of the engine, the lubrication subsystem 104 enables lubrication of the bearings in the bearing unit 116 by circulating lubricating oil through the bearing unit 116. The oil pump 108 is configured to pump the lubricating oil through the supply tube 112 to the bearing unit 116. Also, the lubricating oil is drained from the bearing unit 116 to the oil tank 106 through the scavenge tube 114. The drained lubricating oil is then circulated to the oil pump 108 through the connecting tube 110. It may be noted that although the lubrication subsystem 104 of FIG. 1 is depicted as including the oil tank 106, the oil pump 108, the connecting tube 110, the supply tube 112 and the scavenge tube 114, the lubricating subsystem 104 may include fewer or greater number of components. Some examples of the other components of the lubrication subsystem 104, include, but are not limited to a filtration unit and one or more pressure release valves.

The lubricating subsystem 104 forms a fluid flow subsystem within the engine, where the fluid is a lubricating oil. Flow of the lubricating oil through the lubricating subsystem 104 is vital for the health of the bearing unit 116, and in turn, the health of the engine. Any deposit in a fluid flow component of the fluid flow subsystem, for example, in the scavenge tube 114 of the lubrication subsystem 104, may adversely impact the flow of the lubricating oil. This adverse impact on the flow of the lubricating oil may in turn lead to a catastrophic failure of the engine. It is therefore desirable to ensure an uninterrupted flow of the lubricating oil in the various components of the lubricating subsystem 104 of the engine. Consequently, it may be desirable to determine and/or predict any deposits/blockages in the components of the lubrication subsystem 104 in a timely manner and further to perform condition-based maintenance on the engine to remove these deposits/blockages Furthermore, the control subsystem 102 is operatively coupled to the lubrication subsystem 104. The control subsystem 102 is configured to receive one or more input parameters 118 corresponding to the engine. The input parameters may include operational parameters corresponding to the engine. One example of the input parameters includes a temperature from a gas flow path of the engine. Another example of the input parameters includes a temperature from an exhaust location of the engine. The input parameters may be received from one or more sensors. The input parameters may also be received from a database or a reference table that includes relevant data corresponding to the input parameters of the engine.

In accordance with aspects of the present specification, the control subsystem 102 is configured to predict an amount of total solid deposit in at least one fluid flow component of the engine. In the present example, the control subsystem 102 is configured to predict a total coke deposit in the scavenge tube 114 of the lubricating subsystem 104 based on one or more operational parameters and physics based predictive models. Additionally, the control subsystem 102 may also be configured to determine a condition-based maintenance requirement and/or condition-based maintenance schedule for the engine based on the predicted total coke deposit in the scavenge tube 114.

In addition, the control subsystem 102 may also be configured to generate a notification 120 and/or an alert signal based on the predicted amount of total solid deposit in the scavenge tube 114 of the lubrication subsystem 104 and/or the condition-based maintenance requirement. Moreover, the control subsystem 102 may be configured to communicate the alert signal and/or condition-based maintenance requirement 120 to a user of the system, a remote monitoring system, a maintenance unit, and the like. In some embodiments, the maintenance unit (see FIG. 4) is configured to perform a condition-based maintenance of the engine based on the condition-based maintenance requirement determined by the control system 102. The system 100 and the method for performing the condition-based maintenance will be described in greater detail with reference to FIGS. 2-5.

It may be noted that in certain embodiments, the control subsystem 102 may reside in a location that is remote from a location of the engine, and in particular from the location of the lubrication subsystem 104 and/or the bearing unit 116. In one example, the control subsystem 102 may reside in a control room in a different physical and/or geographical location than that of the engine. It may also be noted that in certain embodiments, the maintenance unit may be a standalone unit that is located in a different physical and/or geographical location than that of the control subsystem (102).

Figure 2:
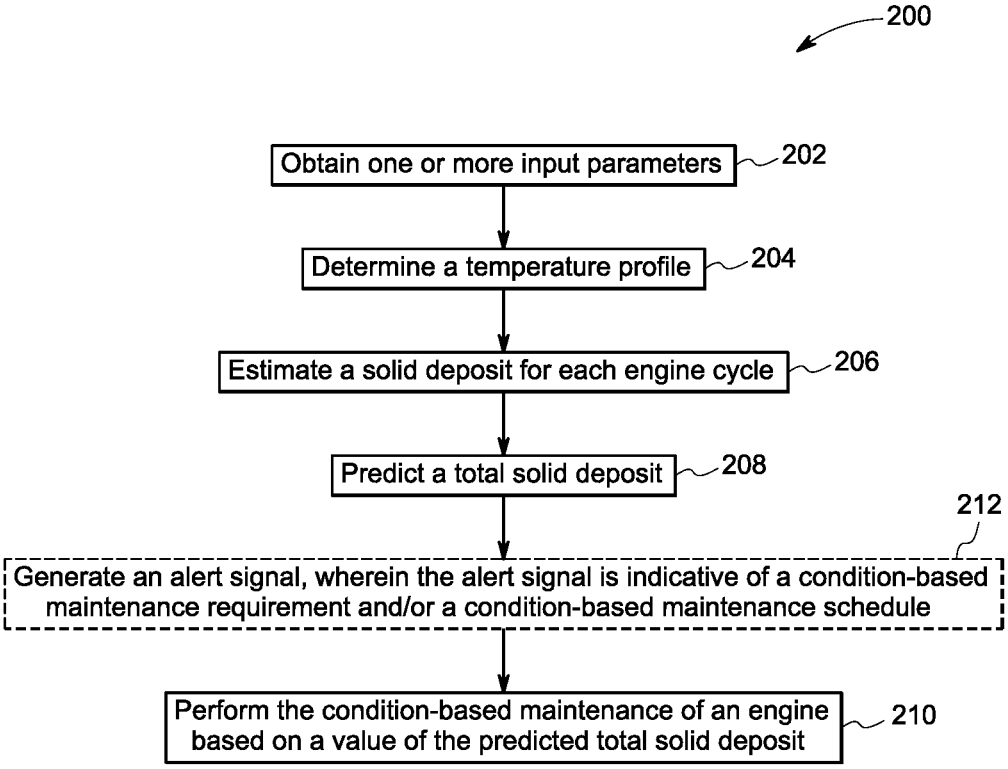
FIG. 2 is a flow chart depicting an exemplary method for performing a condition-based maintenance of an engine, in accordance with aspects of the present specification.

FIG. 2 is a flow chart depicting an exemplary method 200 for performing a condition-based maintenance of an engine, in accordance with some aspects of the present specification. The condition-based maintenance is performed based on a predicted total solid deposit in a fluid flow component of the engine. It may be noted that in the method 200 of FIG. 2, the solid deposit is representative of a coke deposit and the fluid flow component of the engine is representative of a scavenge tube of a lubrication subsystem of the engine. Also, the method 200 is described with reference to the components of FIG. 1.

At step 202, one or more input parameters corresponding to the engine are obtained. As previously noted, these input parameters may include operational parameters corresponding to the engine. In one example, the input parameters may include a temperature corresponding to a gas flow path of the engine, a temperature corresponding to an exhaust location of the engine, and the like.

Subsequently, at step 204, a temperature profile corresponding to a portion of the fluid flow component is determined. As used herein, the term 'temperature profile' refers to values of temperature corresponding to the fluid flow component over a determined period of time. In one example, the determined period of time may include a period of one cycle of operation of the engine. Moreover, the fluid flow component is assumed to include a plurality of portions or segments. It should be noted that the term 'portion' as used herein indicates any single portion of the plurality of portions of the fluid flow component and does not necessarily indicate a specific location or type of portion.

Accordingly, at step 204, a temperature profile corresponding to the portion of the fluid flow component may be determined. In one example, the temperature profile of the portion of the fluid flow component is determined based on a first input parameter of the input parameters and one or more thermal models. In one embodiment, the first input parameter may be a temperature corresponding to an exhaust location or any other gas flow location of the engine. Also, in certain embodiments, the thermal model may be a thermal model of a housing module that encompasses the lubrication subsystem 104 of the engine. In certain other embodiments, the thermal model may be a thermal model of the housing module along with the lubrication subsystem and an exhaust subsystem of the engine.

A thermal model of a component/system is generally representative of a spatial and temporal model of the thermal behavior of the component/system in response to changes in an input parameter. Accordingly, the thermal model may be utilized to estimate the temperature of any part of the component/system based on the input parameter corresponding to any other part of the component/system. By way of example, the thermal model of the housing module along with the lubrication subsystem and the exhaust subsystem may be used to determine a temperature of any part of the lubrication subsystem based on a temperature corresponding to a determined part of the exhaust subsystem or any part of the housing module. In one embodiment, the control subsystem 102 may be employed to determine the temperature profile. To that end, the temperature corresponding to the exhaust location may be measured by a sensor such as a temperature sensor (see FIG. 4). The control subsystem 102 is configured to determine the temperature profile of the portion of the fluid flow component based on the temperature measurements received from the temperature sensor.

Further, at step 206, an amount of solid deposit in at least the portion of the fluid flow component corresponding to each cycle of the engine is estimated. In accordance with aspects of the present specification, the amount of solid deposit for each cycle of the engine is estimated based on the temperature profile and one or more deposition kinetics parameters. It may be noted that for an aviation engine, a single cycle of the engine is representative of a period between engine start-up and engine shutdown. In this example, the single cycle of the engine typically corresponds to a single flight. If the engine is a land based turbine which is deployed for power generation, a single cycle of the engine may be defined in terms of a determined unit of time that the engine is in operation since land based turbines are typically started and shut down at a regular interval. Also, as used herein, a cycle corresponds to a determined amount of usage of the engine and may be representative of a start-stop cycle or a cycle having a fixed time interval. In certain embodiments, the control subsystem 102 may be used to estimate the solid deposit corresponding to each cycle of the engine.

In accordance with exemplary aspects of the present specification, estimating the solid deposit corresponding to each cycle of the engine entails obtaining the one or more deposition kinetics parameters. In certain embodiments, the deposition kinetics parameters may be pre-populated in the control subsystem (102). In other embodiments, the one or more deposition kinetics parameters may be received by the control subsystem (102) during the operation of the engine or during the process of prediction of total solid deposits. Additionally, a deposition rate constant $K_3$ may be computed based on the deposition kinetics parameters. Subsequently, the solid deposit in the portion of the fluid flow component corresponding to each cycle of the engine may be estimated based at least on the computed deposition rate constant $K_3$ and the temperature profile corresponding to the portion of the fluid flow component. In certain embodiments, the deposition rate constant $K_3$ and an amount of solid deposit corresponding to a particular time interval □t in a cycle of the engine may be computed based on equations (1) and (2).

$$K_3 = Ae^{\left(\frac{-E}{RT_{metal}}\right)} \tag{1}$$

In equation (1), $K_3$ is the deposition rate constant, A, E are deposition kinetic parameters, R is a gas constant, and $T_{metal}$ is a temperature corresponding to the portion of the fluid flow component in the particular time interval □t. In some embodiments, the deposition kinetic parameter A may be representative of the Arrhenius factor $A_0$, and the deposition kinetic parameter E may be representative of activation energy $E_a$ of a chemical reaction which results in formation of the solid deposit.

$$R_{solid}=K_3(T_{metal})\times\rho_{solid}\times V \tag{2}$$

Also, in equation (2), $R_{solid}$ is representative of an estimated amount of solid deposit corresponding to the particular time interval □t within the cycle of the engine, □□$_{solid}$ is a density of the solid deposit, and V is a volume of fluid flowing through the portion of fluid flow component during the time interval □t. Additionally, the solid deposit in at least the portion of the fluid flow component corresponding to each cycle of the engine may be estimated by integrating the values of the estimated solid deposits $R_{solid}$ over a period of time corresponding to the entire cycle. The total solid deposit may be represented as $R_{solid\text{-}(cycle)n}$, where n is a representative of a number of cycles that the engine has completed since the previous maintenance of the fluid flow component.

It may be noted that different sections of the portion of the fluid flow component may have different temperatures during the time interval □t. In one example, the temperature $T_{metal}$ may be the maximum temperature of the portion of the fluid flow component during the time interval □t. Furthermore, the temperature $T_{metal}$ may be determined based on the first input parameter corresponding to the time interval □t and one or more thermal models of the housing module that encompasses the fluid flow component. In one embodiment, the temperature $T_{metal}$ is determined based on a temperature corresponding to an exhaust location of the engine during the time interval □t and the one or more thermal models corresponding to the housing module. In one example, the variation of the temperature $T_{metal}$ over a period of time corresponding to a cycle of the engine may be representative of the temperature profile of the portion of the fluid flow component.

As will be appreciated, during subsequent cycles of operation of the engine, the thickness of the solid deposit in the fluid flow component may increase, thereby reducing the fluid flow capacity of the fluid flow system. The reduced fluid flow capacity in the fluid flow system may in turn lead to diminished performance of the engine, and in some situations, a catastrophic failure. Hence, it is desirable to accurately predict the amount of total solid deposit in the fluid flow component. Additionally, it is desirable to be able to generate and/or communicate an alert signal based on the predicted total solid deposit.

Accordingly, at step 208, a total solid deposit in at least the portion of the fluid flow component is predicted based on estimated solid deposits corresponding to each cycle of the engine. In particular, the total solid deposit is predicted by accumulating the estimated solid deposits corresponding to each cycle of one or more cycles of the engine in accordance with equation (3).

$$R_{solid\text{-}(total)n}=R_{solid\text{-}(cycle)1}+R_{solid\text{-}(cycle)2}+\ldots+R_{solid\text{-}(cycle)n} \tag{3}$$

wherein n is number of cycles of the engine since the previous maintenance of the fluid flow component.

In accordance with some embodiments of the present specification, the predicted total solid deposit may be represented as a mass of solid deposit. However, in some other embodiments, the predicted total solid deposit may be represented as a percentage of blockage of the fluid flow component. The percentage of blockage of the fluid flow component may be calculated based on the mass of solid deposit, cross-sectional area of the fluid flow component, and a density of the solid deposit.

Furthermore, at step 210, the condition-based maintenance of the engine based on the predicted total solid deposit is performed. In some embodiments, performing the condition-based maintenance of the engine comprises determining a condition-based maintenance requirement based on a comparison of the total solid deposit with a determined solid deposit threshold value. More particularly, the control subsystem 102 may be configured to compare the predicted total solid deposit with the determined solid deposit threshold value. The solid deposit threshold value may be indicative of a maximum amount of solid deposit permissible in the portion of the fluid flow component before it is desirable to schedule a maintenance of the component. By way of example, if the predicted total solid deposit is greater than or equal to the determined solid deposit threshold value, a condition-based maintenance requirement may be predicted. In accordance with further aspects of the present specification, once the maintenance requirement is predicted, a condition-based maintenance schedule may be generated. In certain embodiments, the control subsystem 102 may be employed to generate the condition-based maintenance schedule. The condition-based maintenance schedule may be indicative of a suggested/optimal schedule for servicing the engine based on the condition-based maintenance requirement.

Additionally, in some embodiments, an alert signal may be generated based on the predicted total solid deposit, as indicated by step 212. The alert signal may be indicative of the condition based maintenance requirement, the condition-based maintenance schedule, or both the condition based maintenance requirement and the condition-based maintenance schedule. In certain embodiments, the control subsystem 102 may be configured to generate the alert signal.

Further, in some embodiments, one or more of the condition-based maintenance schedule, the predicted total solid deposit, the condition-based maintenance requirement, the condition-based maintenance schedule, the temperature profile, the alert signal, or combinations thereof are communicated to a display device, a control unit, a system operator, a remote unit, a maintenance unit, or combinations thereof. More particularly, the control subsystem 102 may be employed to communicate one or more of the alert signal, the estimated solid deposit for a particular cycle, the predicted total solid deposit, the condition-based maintenance requirement and the condition-based maintenance schedule.

In one embodiment, steps 204, 206, 208 that entail determining the temperature profile of the portion of the fluid flow component of the engine, estimating the solid deposit for each cycle, and predicting the total solid deposit may be performed in real-time during the operation of the engine. In another embodiment, one or more of the steps 204, 206, 208 may be performed offline. In this example, the prediction of the total solid deposit in the fluid flow component may be performed during a down time of the engine. Also, the relevant input parameters, such as the temperature at an exhaust location of the engine, may be stored during the operation of the engine, and subsequently this data may be used in the prediction of the total solid deposit.

The method 200 for performing the condition-based maintenance of the engine may further include controlling the engine for performing the condition-based maintenance at a scheduled time based on the condition-based maintenance requirement and/or the condition-based maintenance schedule. In some embodiments, controlling the engine for performing the condition-based maintenance may include stopping the engine operations. In other embodiments, controlling the engine for performing the condition-based maintenance may include changing the engine operations in a manner that enables real-time servicing, online cleaning of the engine while the engine is still in operation, and the like.

Figure 3:
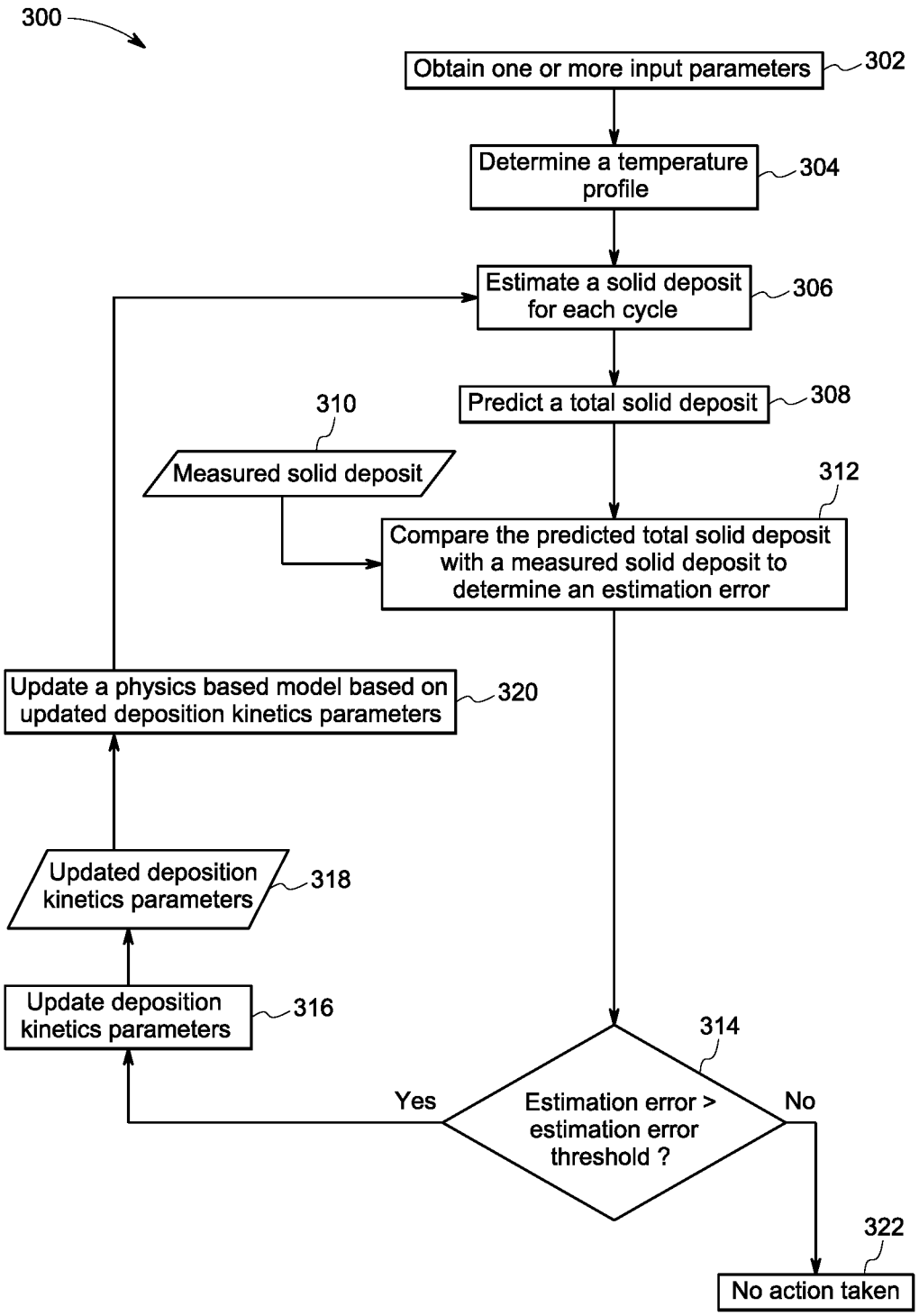
FIG. 3 is a flow chart depicting another exemplary method for performing a condition-based maintenance of an engine, in accordance with aspects of the present specification.

Turning now to FIG. 3, a flow chart depicting another exemplary method 300 of performing a condition-based maintenance of an engine, in accordance with aspects of the present specification, is presented. The condition-based maintenance is performed based on a predicted total solid deposit in a fluid flow component of the engine. The method 300 is described with reference to the components of FIG. 1. It may be noted that in the method 300 of FIG. 3, the solid deposit is representative of a coke deposit and the fluid flow component of the engine is representative of a scavenge tube of a lubrication subsystem of the engine. Moreover, in certain embodiments, the control subsystem 102 may be used to perform one or more of the steps described in method 300.

At step 302, one or more input parameters corresponding to the engine are obtained. The input parameters may include operational parameters corresponding to the engine. In one embodiment, the input parameters may include a temperature corresponding to a gas flow path of the engine, a temperature corresponding to an exhaust location of the engine, and the like.

At step 304, a temperature profile corresponding to a portion of the fluid flow component is determined. In one example, the temperature profile of the portion of the fluid flow component is determined based on one input parameter of the input parameters and one or more thermal models. In one embodiment, the first input parameter may be a temperature corresponding to an exhaust location or any other gas flow location of the engine. Also, in certain embodiments, the thermal model is a thermal model of a housing module that encompasses the lubrication subsystem 104 of the engine. In one embodiment, the control subsystem 102 may be employed to determine the temperature profile. To that end, the temperature corresponding to the exhaust location may be measured by a sensor such as a temperature sensor (see FIG. 4). The control subsystem 102 is configured to determine the temperature profile of the portion of the fluid flow component based on the temperature measurements received from the temperature sensor.

Subsequently, at step 306, a solid deposit in the portion of the fluid flow component corresponding to each cycle of the engine is estimated based on the temperature profile and one or more deposition kinetics parameters. In certain embodiments, the solid deposit corresponding to each cycle of the engine may be estimated based on equations (1) and (2).

Further, at step 308, a total solid deposit in the portion of the fluid flow component may be predicted. More particularly, the total solid deposit in the portion of the fluid flow component may be predicted based on solid deposits corresponding to each cycle of the engine. In one example, the total solid deposit is predicted by accumulating the solid deposits corresponding to the cycles of the engine based on equation (3). In one embodiment, the control subsystem 102 may be employed to predict the total solid deposit.

As will be appreciated, there may exist certain inaccuracies while using physics based predictive models, which in turn may result in non-optimal solutions. In such situations, it is desirable to update and/or tune the models based on real-time data and/or field data, thereby improving the accuracy of the models used for any prediction.

Equations (1), (2) and (3) are representative of a physics based predictive model for predicting the total solid deposit in the portion of the fluid flow component. In accordance with aspects of the present specification, this predictive model may be updated by updating one or more of the deposition kinetics parameters A and E, as shown in step 316.

To that end, in certain embodiments, a measured solid deposit 310 in the fluid flow component may be compared, as shown in step 312, with the predicted total solid deposit. In one example, physical measurement methods may be employed to obtain the measured solid deposit 310. Moreover, in certain examples, the solid deposit 310 may be measured during a down-time of the engine due to a scheduled maintenance or when the engine is out of operation. Some examples of the methods used for measuring the solid deposit 310 include borescope inspection, radiography, and measurements using eddy current. More particularly, in step 312, an estimation error may be determined based on the comparison. The estimation error is representative of a difference between the predicted total solid deposit and the measured solid deposit 310. This estimation error may be employed to update one or more of the deposition kinetics parameters.

Moreover, as indicated by step 314, in one embodiment, a check may be carried out to verify if the estimation error is greater than an estimation error threshold. It may be noted at step 314, a magnitude of the estimation error is compared with a magnitude of the estimation error threshold. At step 314, if it is determined that the estimation error is greater than the estimation error threshold, one or more of the deposition kinetics parameters are updated to generate updated deposition kinetics parameters 318, as depicted by step 316. In one example, the estimation error threshold may have a zero value. However, in other examples, use of non-zero values for the estimation error threshold is envisioned.

Subsequently, at step 320, the physics based model(s) may be updated and/or tuned based on the updated deposition kinetics parameters 318. By way of example, the physics based model represented by equations (1) and (2) may be updated or tuned based on the updated deposition kinetics parameters 318.

In accordance with further aspects of the present specification, a solid deposit corresponding to one or more subsequent cycles of the engine may be estimated using the one or more updated deposition kinetics parameters, thereby enhancing an accuracy of the estimated solid deposit for each cycle and subsequently the predicted total solid deposit.

Referring again to step 314, if it is determined that the estimation error is equal to/lesser than the estimation error threshold, no action may be warranted, as generally indicated by step 322.

Figure 4:
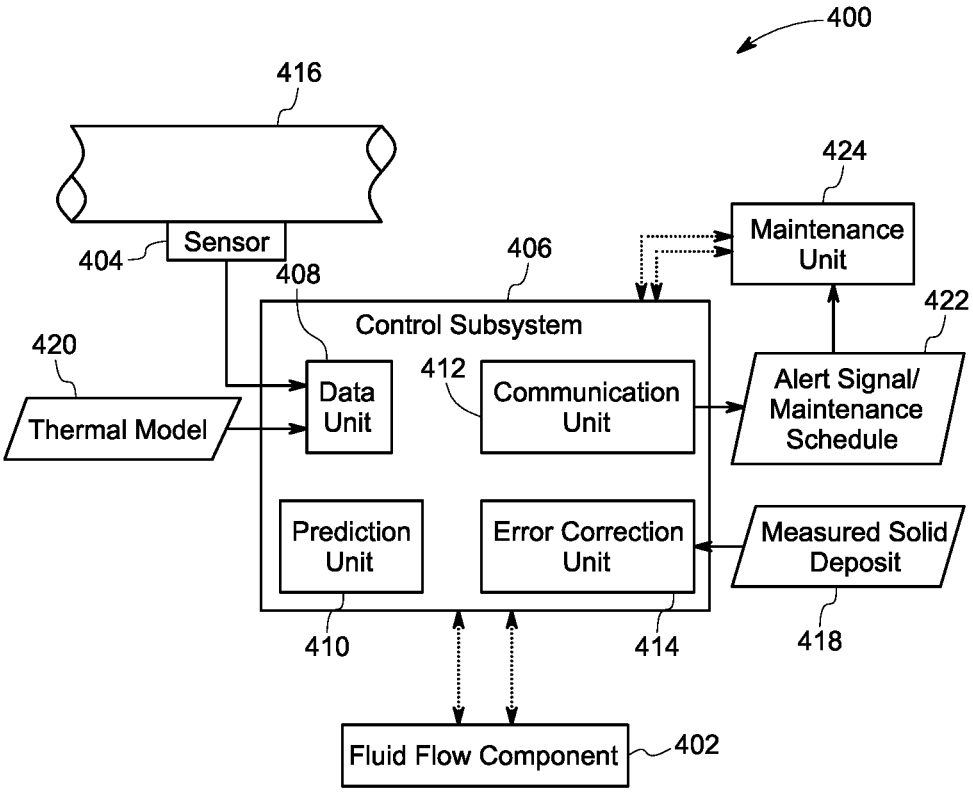
FIG. 4 is a diagrammatical representation of an embodiment of a system for performing a condition-based maintenance of an engine, in accordance with aspects of the present specification.

FIG. 4 is a diagrammatical representation of another embodiment of a system 400 for performing a condition-based maintenance of an engine, in accordance with certain aspects of the present specification.

In a presently contemplated configuration, the system 400 for performing the condition-based maintenance of the engine includes one or more sensors 404 configured to measure one or more input parameters corresponding to the engine. The system 400 also includes a control subsystem 406 operatively coupled to a fluid flow component of the engine. Furthermore, the control subsystem 406 includes at least one data unit 408, at least one prediction unit 410, and at least one communication unit 412. Additionally, the data unit 408, the prediction unit 410, and the communication unit 412 may be operatively coupled to each other. The system 400 also includes a maintenance unit 424 operatively coupled to the control system 406, In one embodiment, the data unit 408 is configured to receive the input parameters corresponding to the engine. It may be noted that at least one of the input parameters is generated by at least one of the one or more sensors 404. As previously noted, these input parameters may include operational parameters corresponding to the engine.

Moreover, at least one of the sensors 404 is a temperature sensor configured to measure a temperature corresponding to a gas flow path of the engine. Further, the sensor 404 may be disposed at an exhaust location of the engine and configured to measure a temperature at the exhaust location of the engine. In one embodiment, a sensor 404 may be disposed within an exhaust pipe 416 of the engine, where the exhaust pipe 416 is configured to convey the exhaust gases. Also, in certain other embodiments, the sensor 404 may be positioned external to the exhaust pipe 416. In one example, the sensor 404 may be in physical contact with the exhaust pipe 416. It may be noted that in certain embodiments, the sensor 404 may be in direct physical contact with the exhaust pipe 416. However, in certain other embodiments, the sensor 404 may be coupled to the exhaust pipe 416 via use of one or more intermediate objects or layers. In yet another embodiment, the sensor 404 may not be in physical contact with the exhaust pipe 416. Accordingly, the temperature sensor 404 may be a contact type or a non-contact type of temperature sensor. Additionally, the temperature sensor 404 may include a thermocouple, an infrared sensor, a semiconductor based sensor, a pyrometer and the like.

The data unit 408 may also be configured to receive and/or store various engine related data including, but not limited to, one or more thermal models 420 corresponding to the engine or engine components, temperature profile information of the engine or engine components, deposition kinetic parameters, deposition rate constants, and the like.

Moreover, in one embodiment, the prediction unit 410 is configured to predict a total solid deposit in a portion of the fluid flow component 402 of the engine. In addition, the prediction unit 410 may also be configured to determine a temperature profile corresponding to the portion of the fluid flow component 402 based on one parameter of the one or more input parameters and the one or more thermal models 420. The thermal model 420 may be a thermal model corresponding to the fluid flow component, the portion of the fluid flow component, the engine, or any other component of the engine. In one example, the thermal model 420 corresponds to a thermal model of a housing module that encompasses a lubrication subsystem 104 of the engine.

Further, to facilitate the prediction of the total solid deposit in a portion of the fluid flow component of the engine, the prediction unit 410 may be configured to estimate a solid deposit in at least the portion of the fluid flow component 402 corresponding to each cycle of the engine based on the temperature profile and one or more deposition kinetics parameters. As previously noted, a cycle corresponds to a determined amount of usage of the engine, and may accordingly be defined as a start-stop cycle or a cycle having a fixed time interval. In accordance with aspects of the present specification, the prediction unit 410 is configured to estimate the solid deposit in the portion of the fluid flow component 402 corresponding to each cycle of the engine using the physics based models represented by equations (1) and (2).

Also, in one embodiment, the prediction unit 410 is configured to predict the total solid deposit in at least the portion of the fluid flow component 402 based on the estimated solid deposits corresponding to each cycle of the engine. In one embodiment, the prediction unit 410 is configured to accumulate the estimated solid deposits for each cycle of the engine to predict the total solid deposit in the portion of the fluid flow component of the engine.

Additionally, the prediction unit 410 may be configured to determine a condition-based maintenance requirement based on the predicted total solid deposit. In one embodiment, the prediction unit 410 is configured to compare the predicted total solid deposit with a determined solid deposit threshold value to verify if the predicted total solid deposit is within acceptable bounds. The solid deposit threshold value may be indicative of a maximum amount of solid deposit permissible in the portion of the fluid flow component before it is desirable to schedule a maintenance of the component for continued safe operations of the engine. Accordingly, the prediction unit 410 may be configured to predict a condition-based maintenance requirement and/or a condition-based maintenance schedule based on the comparison of predicted total solid deposit with the determined solid deposit threshold value. In one example, the prediction unit 410 is configured to predict the condition-based maintenance requirement and/or the condition-based maintenance schedule if the predicted total solid deposit is equal to or greater than the determined solid deposit threshold value.

Further, the communication unit 412 may be configured to communicate one or more of the condition-based maintenance schedule, the predicted total solid deposit, the condition-based maintenance requirement, the temperature profile, an alert signal, or combinations thereof to a display device, a control unit, a system operator, a remote unit, or combinations thereof. The communication unit 412 may also be configured to generate the alert signal 422 based on the comparison of the predicted total solid deposit with the determined solid deposit threshold value. In some embodiments, the communication unit may also be configured to communicate one or more of the alert signal 422, the condition-based maintenance schedule, and the condition-based maintenance requirement to the maintenance unit 424.

Additionally, the maintenance subunit 424 is configured to perform the condition-based maintenance of the engine based on the condition-based maintenance requirement. It may also be noted that in certain embodiments, the maintenance unit 424 may be a standalone unit that is located in a different physical and/or geographical location than that of the control subsystem 406. In some embodiments, the maintenance unit 424 may be a team of service personnel that performs condition-based maintenance on the engine on receiving communication from one or more of the control subsystem 406, the display device, the control unit, the system operator, and the remote unit. In other embodiments, the maintenance unit 424 includes at least one robotic maintenance system, at least one automated maintenance system, or a combination thereof. These robotic/automated maintenance systems may be configured to perform condition-based maintenance on the engine, and more specifically service the affected component of the engine, with or without human intervention. In certain embodiments, the maintenance unit 424 may include service personnel and/or automated/robotic maintenance systems. The automated/robotic maintenance systems may be one or more of crawlers, remote cleaning trolleys, and pods. It may be noted that these automated/robotic maintenance systems may be remotely controlled and/or fully automated.

As previously noted, the solid deposit in the fluid flow component 402 may be coke, and the fluid flow component 402 may be a lubrication subsystem or a component thereof. In another embodiment, the fluid flow component 402 may be a scavenge tube in the lubrication subsystem of the engine.

Furthermore, in certain situations, use of physics based predictive models may result in non-optimal solutions. In such situations, it is desirable to update and/or tune the model(s) based on real-time data to improve the accuracy of the model used for any prediction. In accordance with aspects of the present specification, these physics based predictive models may be updated by updating one or more of the deposition kinetics parameters A and E of equations (1) and (2). To that end, in one embodiment, the control subsystem 406 further includes at least one error correction unit 414, where the error correction unit 414 may be operatively coupled to one or more of the data unit 408, the prediction unit 410, and the communication unit 412. Furthermore, the error correction unit 414 is configured to compare the predicted total solid deposit with a measured solid deposit 418 corresponding to the portion of the fluid flow component to determine an estimation error. The estimation error is generally representative of a difference between the predicted total solid deposit and the corresponding measured solid deposit 418. It may be noted that the measured solid deposit 418 is representative of the solid deposit in a component of the engine that is measured during a down-time of the engine due to a scheduled maintenance or when the engine is out of operation.

The error correction unit 414 may be configured to update one or more deposition kinetics parameters based on the estimation error. In particular, the error correction unit 414 is configured to compare the estimated error with a determined estimation error threshold. In certain embodiments, if a magnitude of the estimation error is greater than a magnitude of the estimation error threshold, the error correction unit 414 is configured to update one or more deposition kinetics parameters. In one example, the estimation error threshold may have a zero value. However, in other examples, the estimation error threshold may have non-zero values.

In addition, the physics based model may be updated based on the updated deposition kinetics parameters. These updated deposition kinetic parameters and/or the updated physics based model may be communicated to the data unit 408. In a subsequent cycle of the engine, the prediction unit 410 may use the updated deposition kinetics parameters to estimate the solid deposit for that cycle.

Figure 5:
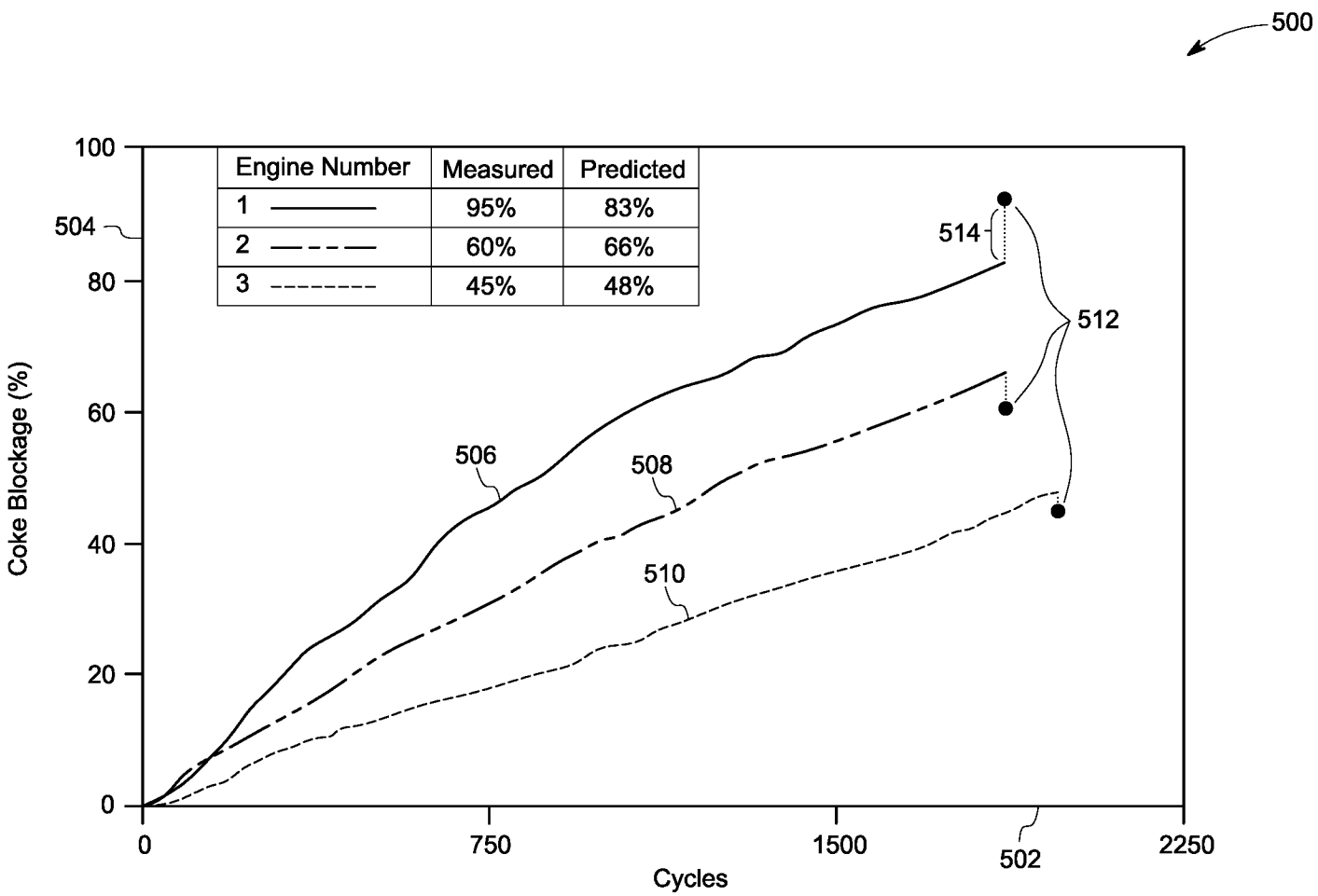
FIG. 5 is a graphical representation depicting predicted values of total coke deposit for different engines as a function of a number of engine cycles, in accordance with aspects of the present specification.

FIG. 5 depicts a graphical representation 500 of predicted values of total amount of coke deposit in portions of fluid flow components of three different engines as a function of a number of cycles of each engine. In particular, FIG. 5 is a graphical representation of the step of predicting the total coke deposit (208, 308) in the fluid flow component of the engine (see FIGS. 2 and 3). It may be noted that in FIG. 5, a value of the amount of coke deposit is represented as a percentage of the portion of the fluid flow component that is blocked due to the coke deposit, i.e., a coke blockage percentage.

Reference numeral 502 represents an X-axis and reference numeral 504 represents a Y-axis. The X-axis 502 is representative of a number of cycles of one or more engines, while the Y-axis 504 represents the values of total coke deposit in the fluid flow components of the respective engines. Curves 506, 508 and 510 correspond to engines numbered 1, 2, and 3 respectively. Also, the curves 506, 508 and 510 are representative of a variation in the predicted total coke deposit as a function of the number of cycles of corresponding engines. The predicted total coke deposit at any stage of engine operation may be compared with a threshold value of a total coke deposit to determine the condition-based maintenance requirement. Additionally, a condition-based maintenance schedule may also be generated. Further, this condition-based maintenance requirement and/or the condition-based maintenance schedule may be communicated to a maintenance unit, which may then perform condition-based maintenance on the specific engine.

In addition, corresponding measured values of actual coke deposit in these engines are represented by reference numeral 512 in FIG. 5. The actual coke deposit (measured coke deposit) is represented as a measured blockage percentage of the portion of the fluid flow component of the corresponding engine. By way of example, for engine number 1, the predicted value of total coke deposit after 1856 cycles of operation is about 83%, whereas the observed or measured value of the actual coke deposit after 1856 cycles is 95%. Reference numeral 514 is generally representative of a difference between the predicted total coke deposit and the measured coke deposit in the portion of the fluid flow component for engine number 1. This difference 514 is representative of an estimation error determined at step 312 of FIG. 3. In some embodiments, this estimation error 514 is determined by the error correction unit 414 of FIG. 4. In this example, the estimation error 514 is about 12%. The estimation error 514 is compared with an estimation error threshold. If the estimation error 514 is greater than and/or equal to the estimation error threshold, the error correction unit 414 is configured to update the values of one or more deposition kinetics parameters and the corresponding physics based predictive models. Subsequently, the updated values of one or more deposition kinetics parameters are used for any further predictions for engine number 1.

Figure 6:
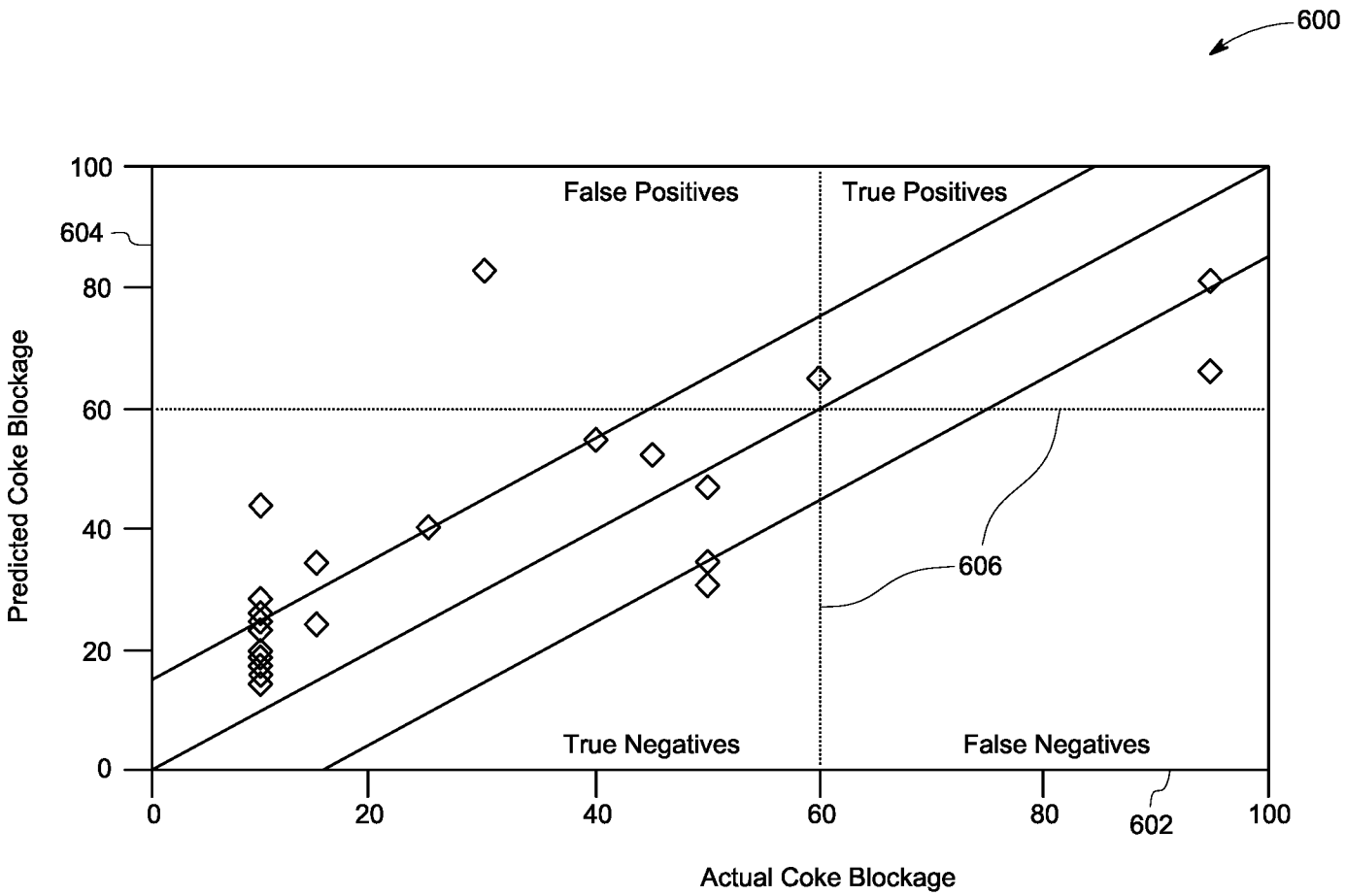
FIG. 6 is a graphical representation depicting a comparison of predicted values of total coke deposit and actual values of coke deposit for different engines.

FIG. 6 is a graphical representation 600 of a comparison of predicted values of total coke deposit with corresponding actual values (measured values) of total coke deposit in portions of fluid flow components for different engines. Reference numeral 602 represents an X-axis, while a Y-axis is represented by reference numeral 604. Also, the actual/measured values of total coke deposit are depicted along the X-axis 602, while corresponding predicted values of total coke deposit are depicted along the Y-axis 604. It may be noted that in FIG. 6, the actual coke deposit as well as the predicted total coke deposit are depicted as percentages of blockage of the respective portions of fluid flow components of the engines. It may be noted that the terms 'coke blockage percentage,' 'coke deposit value,' and 'coke deposit' may be used interchangeably.

In the present example, a coke deposit of 60% is identified as a threshold coke deposit value 606 of the coke deposit. Accordingly, if a predicted total coke deposit equals or exceeds the threshold coke deposit value 606, it may be desirable to schedule a condition-based maintenance of the engine to expunge the coke deposit from the scavenge tube.

As illustrated in FIG. 6, comparing the predicted values of total coke deposit 604 with the values of actual (measured) coke deposit 602 may result in one of a true negative result, a true positive result, a false negative result, and a false positive result. A false negative result is representative of a scenario where the predicted value of coke deposit is less than the threshold coke deposit value 606 of 60%, whereas the actual value of coke deposit is greater than 60%. In this example, while the predicted value of total coke deposit indicates that maintenance of the engine is not recommended, however, the actual value of coke deposit indicates that maintenance of engine is required.

Similarly, a false positive result is indicative of a situation where the predicted value of total coke deposit is greater than 60%, whereas the actual value of coke deposit is less than 60%. In this example, while the predicted value of total coke deposit indicates that maintenance of the engine is recommended, however, the actual value of coke deposit indicates that maintenance of engine is not required.

It may be noted that a false negative result may lead to a failure to service the engine based on the predicted value of total coke deposit and may result in a catastrophic failure of the engine. However, a false positive result leads to a scheduled servicing of the engine based on the predicted value of total coke deposit, where none is required. This example leads to additional cost and effort, and lost revenues due to loss of productivity. As clearly depicted by the graphical representation 600 of FIG. 6, data shown for different engines in this example presents one false positive result and no false negative results.

The systems and methods for performing condition-based maintenance of an engine can also be extrapolated to a fleet of engines containing multiple engines. Accordingly, in one embodiment, use of the methods and systems for performing the condition-based maintenance of one or more engines is also envisioned. Additionally, one or more input parameters, physics based predictive models, as well as thermal models for each engine of the fleet of engines may be used to predict the total solid deposit in fluid flow components of each engine of the fleet. This can be used to determine the condition-based maintenance requirement of each engine of the fleet. Accordingly, alert signals corresponding to one or more engines of the fleet may be generated. Further, the condition-based maintenance of the fleet of engines may be determined and performed in an organized and efficient manner.

Various systems and methods for performing a condition-based maintenance of an engine are presented. These systems and methods enable condition-based maintenance of the engine instead of the traditional, fixed interval maintenance, thereby minimizing the down time of the engine. Moreover, the systems and methods employ physics based models to predict the amount of blockage in the scavenge tube and leverage existing thermal models used in engine design to estimate the field temperatures in the component of interest. Additionally, field data is used to fine-tune the model parameters to improve accuracy of the physics based models, thereby enhancing the prediction of the total coke deposits in various components of the engine.

Also, the systems and methods provide a notification of total solid deposits that exceed allowable thresholds, thereby averting potential catastrophic failures of the engine. In addition, certain outputs provided by the systems and methods (for example, the predicted total solid deposit at any given point of time) may be used for advance planning of a condition-based maintenance schedule. Implementing the systems and methods as described hereinabove, allow for condition-based maintenance planning, thereby improving productivity or time-on-wing, for aviation engines, and reducing additional maintenance costs. Additionally, the systems and methods may be used to plan and perform maintenance a fleet of engines based on a predicted requirement for condition-based maintenance for each engine.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The invention claimed is:

1. A method for performing a condition-based maintenance of an engine, the method comprising:

obtaining one or more parameters corresponding to the engine;

determining a temperature profile corresponding to a portion of a fluid flow component in the engine based at least on one parameter of the one or more parameters and one or more thermal models;

estimating a solid deposit in at least the portion of the fluid flow component corresponding to each cycle of the engine based on the temperature profile and one or more deposition kinetics parameters;

predicting a total solid deposit in at least the portion of the fluid flow component based on the estimated solid deposit corresponding to each cycle of the engine; and performing the condition-based maintenance of the engine based on the predicted total solid deposit, wherein the portion of the fluid flow component comprises a component in a lubrication subsystem of the engine, the thermal model being of a housing system encompassing the lubrication subsystem.

2. The method of claim 1, wherein the one or more parameters comprise a temperature corresponding to one or more exhaust locations of the engine.

3. The method of claim 1, wherein estimating the solid deposit corresponding to each cycle of the engine comprises:

obtaining the one or more deposition kinetics parameters;

computing a deposition rate constant based on the one or more deposition kinetics parameters; and estimating the solid deposit in at least the portion of the fluid flow component corresponding to each cycle of the engine based on the computed deposition rate constant and the temperature profile corresponding to the portion of the fluid flow component.

4. The method of claim 1, wherein predicting the total solid deposition comprises accumulating the estimated solid deposits corresponding to each cycle of the engine.

5. The method of claim 1, wherein performing the condition-based maintenance of the engine comprises determining a condition-based maintenance requirement based on a comparison of the total solid deposit with a determined solid deposit threshold value.

6. The method of claim 5, further comprising generating an alert signal, wherein the alert signal is indicative of the condition based maintenance requirement, a condition-based maintenance schedule, or both the condition based maintenance requirement and the condition-based maintenance schedule.

7. The method of claim 6, further comprising communicating one or more of the condition-based maintenance schedule, the predicted total solid deposit, the condition-based maintenance requirement, the temperature profile, the alert signal, or combinations thereof to a display device, a control unit, a system operator, a remote unit, a maintenance unit, or combinations thereof.

8. The method of claim 6, further comprising controlling the engine for performing the condition-based maintenance at a scheduled time based at least on the condition-based maintenance requirement.

9. The method of claim 1, wherein the solid deposit comprises coke.

10. The method of claim 1, further comprising updating one or more of the one or more deposition kinetics parameters.

11. The method of claim 10, further comprising comparing the predicted total solid deposit to a measured solid deposit.

12. The method of claim 10, further comprising estimating the solid deposit corresponding to a subsequent cycle of the engine based on one or more updated deposition kinetics parameters.

13. A system for performing a condition-based maintenance of an engine, the system comprising:

one or more sensors configured to measure one or more parameters corresponding to the engine;

a control subsystem operatively coupled to a fluid flow component of the engine, wherein the control subsystem comprises:

at least one data unit configured to receive the one or more parameters corresponding to the engine and determine a temperature profile corresponding to a portion of a fluid flow component in the engine based at least on one parameter of the one or more parameters and one or more thermal models;

at least one prediction unit configured to:

estimate a solid deposit in at least the portion of the fluid flow component corresponding to each cycle of the engine based on the temperature profile and one or more deposition kinetics parameters;

predict a total solid deposit in a portion of the fluid flow component of the engine based on the estimated solid deposit corresponding to each cycle of the engine; and determine a condition-based maintenance requirement based on the predicted total solid deposit; and at least one communication unit configured to communicate one or more of a condition-based maintenance schedule, the predicted total solid deposit, the condition-based maintenance requirement, the temperature profile, an alert signal, or combinations thereof to a display device, a control unit, a system operator, a remote unit, or combinations thereof; and a maintenance unit operatively coupled to the control subsystem, wherein the maintenance unit is configured to perform the condition-based maintenance of the engine based on the condition-based maintenance requirement, wherein the portion of fluid flow component comprises a component in a lubrication subsystem of the engine, the thermal model being of a housing system that encompassing the lubrication subsystem.

14. The system of claim 13, wherein at least one of the one or more sensors is a temperature sensor disposed at an exhaust location of the engine.

15. The system of claim 13, wherein the solid deposit comprises coke.

16. The system of claim 13, wherein the prediction unit is configured to determine the condition-based maintenance requirement based a comparison of the predicted total solid deposit with a determined solid deposit threshold value.

17. The system of claim 13, wherein the control subsystem further comprises at least one error correction unit, and wherein the error correction unit is configured to:

compare the predicted total solid deposit with a measured solid deposit corresponding to the portion of the fluid flow component; and update one or more deposition kinetics parameters based on the comparison.

18. The system of claim 13, wherein the maintenance unit comprises of one or more of at least one robotic maintenance system, at least one automated maintenance system, or a combination thereof.

19. A system, comprising:

an engine comprising at least a lubrication subsystem;

at least one sensor configured to measure a temperature of at an exhaust location of the engine;

a control subsystem operatively coupled to the lubricating subsystem and the at least one sensor, wherein the control subsystem comprises:

a data unit configured to receive temperature data from the at least one sensor;

a prediction unit configured to:

determine a temperature profile corresponding to a portion of a lubrication subsystem based on the temperature data and one or more thermal models;

estimate a coke deposit in at least the portion of the lubrication subsystem corresponding to each cycle of the engine based on the temperature profile and one or more deposition kinetics parameters;

predict a total coke deposit in at least the portion of the lubrication subsystem based on the estimated coke deposit corresponding to each cycle of the engine; and determine a condition-based maintenance requirement based on a comparison of the predicted total coke deposit with a determined coke deposit threshold value;

an error correction unit configured to:

compare the predicted total coke deposit with a measured coke deposit corresponding to at least the portion of the lubrication subsystem; and update one or more deposition kinetics parameters based on the comparison; and a communication unit configured to communicate one or more of a condition-based maintenance schedule, the condition-based maintenance requirement, the predicted total solid deposit, the temperature profile, an alert signal, or combinations thereof to a display device, a control unit, a system operator, a remote unit, a maintenance unit, or combinations thereof; and a maintenance unit operatively coupled to the control subsystem, wherein the maintenance unit is configured to perform the condition-based maintenance of the engine based on the condition-based maintenance requirement, wherein the thermal model is a thermal model of a housing system encompassing the lubrication subsystem.

* * * * *